United States Patent [19]

Bojsen

[11] Patent Number: 4,706,763

[45] Date of Patent: Nov. 17, 1987

[54] RAPPING MECHANISM FOR AN ELECTROSTATIC PRECIPITATOR

[75] Inventor: Erik M. Bojsen, Copenhagen, Denmark

[73] Assignee: F. L. Smidth & Co. A/S, Denmark

[21] Appl. No.: 831,357

[22] Filed: Feb. 20, 1986

[30] Foreign Application Priority Data

Feb. 22, 1985 [GB] United Kingdom ..... 8504614

[51] Int. Cl.[4] ..... B03C 3/76

[52] U.S. Cl. ..... 173/100; 55/112; 55/300

[58] Field of Search ..... 173/92, 94, 98, 99, 173/100; 55/112, 300

[56] References Cited

U.S. PATENT DOCUMENTS

| | | | |
|---|---|---|---|
| 2,867,204 | 1/1959 | Arvay | 173/100 |
| 4,221,573 | 9/1980 | Hankins | 55/112 |
| 4,519,817 | 5/1985 | Gibbons | 173/100 |

FOREIGN PATENT DOCUMENTS

| | | | |
|---|---|---|---|
| 505794 | 8/1930 | Fed. Rep. of Germany | 55/112 |
| 1632434 | 3/1971 | Fed. Rep. of Germany | 55/112 |
| 2138710 | 10/1984 | United Kingdom | 173/100 |
| 445469 | 2/1975 | U.S.S.R. | 55/112 |

*Primary Examiner*—E. R. Kazenske
*Assistant Examiner*—Hien H. Phan
*Attorney, Agent, or Firm*—Brumbaugh, Graves, Donohue & Raymond

[57] ABSTRACT

A rapping mechanism for an electrostatic precipitator comprises hammers (1) which are swingable on a shaft (2) carrying a driver pin (6). As the shaft rotates, the driver pin (6) engages a surface (7) of a pawl (4), which is pivoted on the hammer (1), thus picking up and raising the hammer until the pawl (4) is disengaged from the driver pin (6) by an adjustable release tap (9). The hammer then swings back down under gravity and raps a bar (13) connected to electrodes.

5 Claims, 1 Drawing Figure

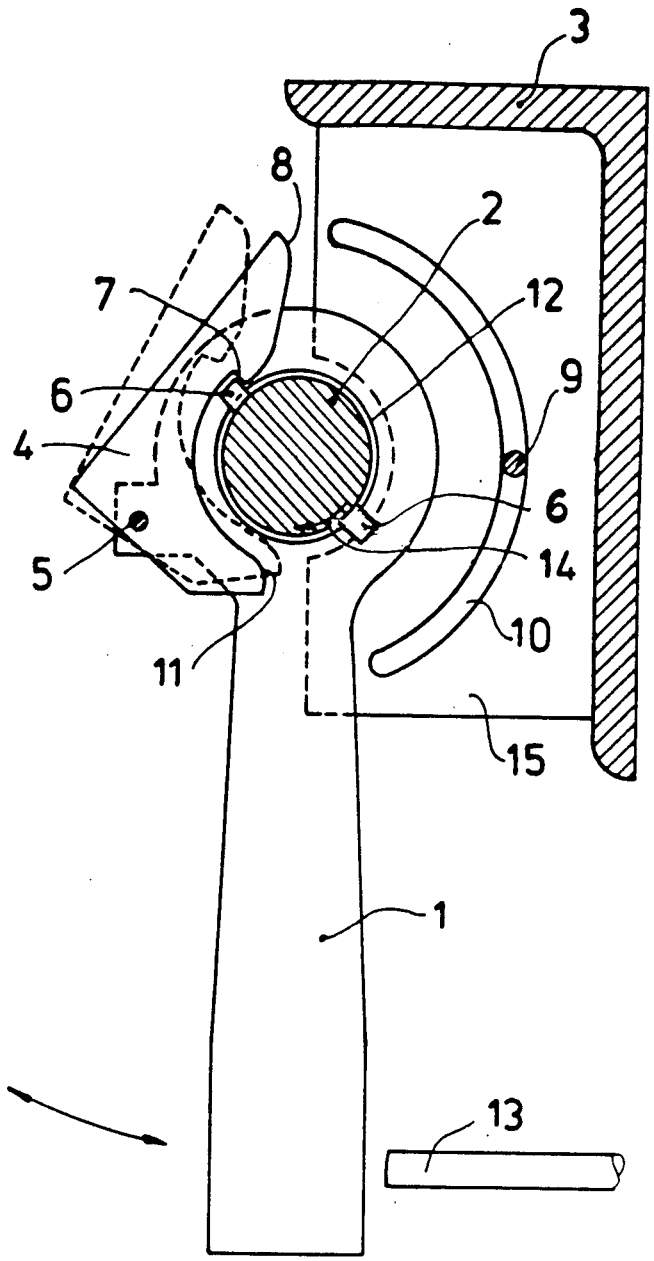
3
8
2
7
12
6
9
4
6
5
14
10
11
15
1
13

RAPPING MECHANISM FOR AN ELECTROSTATIC PRECIPITATOR

The invention relates to a rapping mechanism for rapping the electrodes of an electrostatic precipitator in which a plurality of hammers are, in use, repeatedly swung up from a rest position by a rotating shaft and then released so as to fall back to a hitting position in which the kinetic energy of the hammers is transferred to at least one rapping bar and hence to the precipitator electrodes. Such a mechanism is hereinafter referred to as of the kind described.

Such a rapping mechanism is known from U.S. Pat. No. 3,844,742 wherein the hammers are mounted pivotally about bearings axially parallel with, but eccentric to the shaft, at the end of cross members secured to, and rotating with, the shaft.

In this known mechanism the hammers follow the rotation of the shaft so as to describe a full circle of 360°. For the first 180° they are moved by the rotation of the shaft and upon reaching their vertical position they tip over and fall through 180° so as to hit in their lower position a horizontal rapping bar which is connected to the electrodes. There may also be used a vertical rapping bar which is hit by the hammers after a drop of approximately 90°.

This known rapping mechanism has several disadvantages, one of which is that the falling distance of the hammers is constant, as consequently is the rapping energy delivered by the hammers through their fall. A change in the rapping energy may therefore only be achieved by changing the hammer length and/or weight i.e. several types of hammers must be used.

It is another disadvantage that, in order to rotate through 360°, the hammers require room at the end of the electrode rows corresponding to at least twice the length of the hammers, which means that the precipitator housing must be made correspondingly longer, thus causing a substantial increase in construction materials.

It is a further disadvantage that, having given off their rapping energy to the rapping bars, the hammers, during their further rotation slide over the ends of the bars, causing considerable wear on both bars and hammers.

No. GB-A-2138710 discloses a hammer mechanism where the hammers do not follow the shaft for 360°, but instead are only moved between 0° and 180°. The individual hammers are suspended from a bearing, concentrically with which they are provided at their upper ends with a gear sector. The attachment bearings of the hammers lie axially parallel with the shaft at such a distance that gear sectors on the shaft, at a certain time during the rotation of the shaft pass into mesh with the gear sectors of the hammers, so that the hammers are rotated in the opposite direction to that of the shaft until the last tooth on the gear sector of the shaft disengages from the gear sector of the hammer, allowing the hammer to fall back towards its rest position. By varying the length of the gear sectors the hammer movements may be preset at a desired value.

Although this solution complies with the demand for setability of the rapping power and for the hammer only moving on one side of a vertical plane through the shaft movement, it is not without significant drawbacks. Thus, the setability is limited to individual discrete values determined by the possible number of teeth on the gear sectors on the shaft and on the hammer, and the set value is difficult to change as such a change demands replacement of the gear sectors.

Consequently, it is the object of the invention to provide a hammer mechanism of the kind described in which the rotating hammer is moved to a position which is easily setable between 0° and 180°, and in which the drawbacks of the known art are overcome.

According to the invention the object is achieved by a hammer mechanism of the kind described which is characterized in that each hammer is suspended from, and freely swingable on, the shaft which carries a driver member for the hammer; a latch is mounted on the hammer for movement between positions in which an engagement surface of the latch is clear of, and is in, the path of rotation of the driver member; and there is a stationary release member; the arrangement being such that, as the shaft rotates, repeatedly, the driver member engages the latch engagement surface and hence picks up the hammer which is thus caused to swing up from its rest position until the latch reaches the release member which moves the latch out of engagement with the driver member, allowing the hammer to swing down again under gravity so as to hit the rapping bar and then to settle in its rest position.

It is possible to position the release member so as to release the respective hammer when it has been raised by exactly the right amount to provide the desired rapping energy.

Preferably, the release member is adjustable in position for adjusting the angle through which the hammer is swung up prior to its release.

As the hammer is always moved less than 180° there may be, for one or more of the hammers, two diametrically opposed driver members on the shaft, thus providing two raps per shaft rotation and reducing wear on the shaft bearings.

The latch is preferably pivotally mounted on the hammer and may then be so constructed as seek to return under gravity towards the position in which its engagement surface is in the path of the driver member when the hammer is in its rest position. However, in case the latch should stick, the latch may have a cam surface which, when the latch is in its position in which its engagement surface is clear of the path of the driver member, is in the path of the driver member, so that as the driver member approaches the latch, it first engages the cam surface and causes the latch to pivot to its position in which its engagement surface is in the path of rotation of the driver member.

The invention will now be explained in more detail with reference to the accompanying drawing which diagrammatically shows in section rapping mechanism according to the invention.

Normally an electrostatic precipitator has a plurality of hammers mounted on a common shaft, which extends across the precipitator and is supported by bearings mounted on the supporting structure of the precipitator housing. The drawing shows one of these hammers and its appertaining driving mechanism.

A hammer 1 mounted at the end of is shank on a bearing 12 encompassing a shaft 2 which rotates in the direction indicated by the arrow 14.

At its bearing end, the hammer 1 has a pin 5 extending parallel with the shaft 2, and on which a latch 4 is pivotally mounted. The latch 4 comprises a pawl with an engagement surface 7, which in one position of the latch can be engaged by a driver pin 6, mounted on, and rotating with the shaft 2, thus forcing the hammer to rotate with the shaft and move from its neutral, hanging down position to a certain distance from the rapping bar 13.

At a given time durng this rotating movement an upper arcuate cam surface 8 on the latch hits a release tap 9 mounted on a bracket of the supporting construction of the precipitator housing. During the further rotation of the shaft 2 and the hammer 1 the latch, by its abutment on the release tap 9, will pivot backwards about the pin 5. When the latch has reached the position corresponding to the dotted lines, the surface 7 of the pawl rides off the driver pin 6, and the hammer 1, freely rotating about its bearing 12, falls back through its vertical position and gives off its free energy to the rapping bar 13, which transfers the rapping energy to the respective electrode section.

The latch is so constructed that, through the action of gravity it automatically seeks to pivot back to its position with the surface 7 in the path of rotation of the driver pin 6 when the hammer is hanging down in its neutral position. If dust, deposited from the dusty environment in the precipitator, hinders the movement of the latch so that it cannot be moved by gravity alone, the driver pin will through its further rotation reach the cam surface 11 on the latch 4 which is thereby forced back to the position with the surface 7 in the path of the driver pin.

In the example shown, the release tap 9 is mounted in a semi-circular slot 10 in a wall 15 which is mounted on a bracket 3 extending perpendicular to the axis of the shaft. The slot has its centre on the axis of the shaft, and the release tap is movable to and fixable in, any position in the slot, so that the movement height of the hammer from the rapping bar 13, and consequently the rapping energy delivered, to the bar, can be preset at any desired value within a maximum fall of 180° of the hammer.

Instead of the slot, the wall 15 may have holes positioned along a circular-arc for the release tap whereby the preset rapping values can be obtained by placing the tap in the corresponding hole. A safety rod or tap may be used to ensure that the latch is disengaged from the driver pin 6 immediately before the hammer reaches its upper vertical position so that the hammer does not follow the rotation for more than a little less than 180°, in case of malfunction of the release tap 9.

It will be appreciated that the rapping mechanism preferably includes a plurality of hammers, each suspended from the shaft 2 and located at a separate position along the length of the shaft. Similarly, a plurality of walls 15 can be mounted along the length of the bracket 3 such that there is a wall and release tap 9 associated with each hammer.

I claim:

1. A rapping mechanism for rapping the electrodes of an electrostatic precipitator, said mechanism, comprising:

at least one hammer which is adapted to be swung up from a rest position by a rotating shaft and then released so as to fall back to a hitting position in which the kinetic energy of said hammer is transferred to at least one rapping bar and hence to said precipitator electrodes, said hammer being suspended from, and freely swingable on, said shaft which carries a driver member for said hammer, said driver member having a path of rotation upon rotation of said shaft; wherein a latch is pivotally mounted on said hammer for movement between positions in which an engagement surface of said latch is clear of, and is in, said path of rotation of said driver member; and a stationary release member located such that as said shaft rotates repeatedly, said driver member engages said latch engagement surface and hence picks up said hammer which is thus caused to swing up from a rest position until said latch reaches said release member which moves said latch out of engagement with said driver member, allowing said hammer to swing down again under gravity so as to hit said rapping bar and then to settle in said rest position.

2. A rapping mechanism according to claim 1, wherein said release member is adjustable in position for adjusting the angle through which said hammer is swung up prior to release thereof by said latch member.

3. A rapping mechanism according to claim 2, wherein said release member is adjustable along a part circular slot which is concentric with said shaft.

4. A rapping mechanism according to claim 1, wherein there are two diametrically opposed driver members on said shaft.

5. A rapping mechanism for rapping electrodes of a electrostatic precipitator, said mechanism, comprising:

at least one hammer which is adapted to be swung up from a rest position by a rotating shaft and then released so as to fall back to a hitting position in which the kinetic energy of said hammer is transferred to at least one rapping bar and hence to said precipitator electrodes, said hammer being suspended from and freely swingable on, said shaft which carries a driver member for said hammer, said driver member having a path of rotation upon rotation of said shaft;

a latch, pivotally mounted on said hammer for movement between positions in which an engagement surface of said latch is clear of, and is in, said path of rotation of said driver member, wherein said latch also has a cam surface which, when said latch is in its position in which said engagement surface is clear of said path of rotation of said driver member, is in said path of rotation of said driver member, so that as said driver member approaches said latch, said driver member first engages said cam surface and causes said latch to pivot to its position in which said engagement surface is in said path of rotation of said driver member; and a stationary release member, the arrangement of said release member being such that, as said shaft rotates repeatedly, said driver member engages said latch engagement surface and hence picks up said hammer which is thus caused to swing up from a rest position until said latch reaches said release member which moves said latch out of engagement with said driver member, allowing said hammer to swing down again under gravity so as to hit said rapping bar and then to settle in said rest position.

* * * * *